US007394044B2

(12) United States Patent
Brun et al.

(10) Patent No.: US 7,394,044 B2
(45) Date of Patent: Jul. 1, 2008

(54) DEVICE FOR EXCHANGING HEAT

(75) Inventors: Michel Brun, Rustenhart (FR); Maxime Mundel, Pfaffenheim (FR); Pascal Miss, Selestal (FR); Stèphane Jaoaen, Nordhouse (FR); Christophe Schmittheisler, Epfine (FR); Mathieu Mougey, Ensisheim (FR); Jean-Blaise Hils, Reichsfeld (FR); Claude Lengert, Obernai (FR)

(73) Assignee: Behr France Rouffach SAS, Rouffach (FR)

( * ) Notice: Subject to any disclaimer, the term of this patent is extended or adjusted under 35 U.S.C. 154(b) by 424 days.

(21) Appl. No.: 10/963,282

(22) Filed: Oct. 12, 2004

(65) Prior Publication Data

US 2005/0103469 A1 May 19, 2005

(30) Foreign Application Priority Data

Oct. 10, 2003 (EP) ..... 03292526

(51) Int. Cl.
*H05B 3/08* (2006.01)
*H01R 13/187* (2006.01)

(52) U.S. Cl. ..... 219/541; 439/844

(58) Field of Classification Search ..... 219/541, 219/538, 202; 338/322, 328, 333, 25, 20, 338/7, 3; 439/714, 844
See application file for complete search history.

(56) References Cited

U.S. PATENT DOCUMENTS 4,128,291 A * 12/1978 Peterson, Jr. ..... 439/786
4,220,845 A * 9/1980 Morreale ..... 219/243
4,346,285 A 8/1982 Nakamura et al.
4,763,224 A * 8/1988 Bentz et al. ..... 361/704
4,850,879 A * 7/1989 Langenbahn ..... 439/10
5,565,121 A * 10/1996 Forslund ..... 219/217
5,676,872 A * 10/1997 Garcia-Rodriguez ..... 219/549
6,055,360 A 4/2000 Inoue et al.

FOREIGN PATENT DOCUMENTS

EP 884803 12/1998
FR 2794605 12/2000

* cited by examiner

*Primary Examiner*—Daniel Robinson
(74) *Attorney, Agent, or Firm*—Greer, Burns & Crain, Ltd.

(57) ABSTRACT

A device for exchanging heat for motor vehicles, having at least one first component connected to an electrical power supply and whose temperature varies dependent on current flowing through the component, at least one second component including at least one first and at least one second part element each of which are at least indirectly conductively connected to the first component, wherein at least one part element includes a first connecting means and at least one electrical contact means which is at least indirectly conductively connected to at least one part element of at least one second component and serves to connect an electrical power supply wherein the contact means includes at least one second connecting means. Both of the connecting means include at least one flat portion and the first and the second connecting means interlock so as to result in a form-fitting connection between the first and the second connecting means and electrical contact is established at least between a primary surface of the flat portion of said first connecting means and a major face of the flat portion of said second connecting means.

27 Claims, 3 Drawing Sheets

DEVICE FOR EXCHANGING HEAT

SUMMARY

BACKGROUND

The present invention relates to a device for exchanging heat, in particular for motor vehicles. In air conditioning systems for motor vehicles, electrical heating devices are increasingly used which serve for example to defrost the windshield directly after starting or to heat the passenger compartment.

In the prior art heating systems are known comprising heating elements such as in particular PTC heating elements which heat up due to current flowing through. Metal contact sheets are provided being in electrical connection both with the heating element and a power supply.

In the prior art riveted plug connections are known between the power supply and the contact sheets. However, said riveted plug connections have the disadvantage to offer only a relatively small contact surface between the contact sheet and the plug connection. This in turn will result in relatively high temperatures due to current flowing between the plug connection and the contact sheet.

It is therefore the object of the present invention to improve connection with the contact sheet.

The present invention relates to a device for exchanging heat, in particular for motor vehicles, having at least one first component connected to an electrical power supply, and whose temperature varies dependent on current flowing through the component, and at least one second component comprising at least one first and at least one second part element each of which are at least indirectly conductively connected to the first component, wherein at least one part element comprises a first link plate in particular at one end.

In addition at least one electrical contact means is provided which is conductively connected to the link plate of the at least one part element by means of a first connecting means and serves to connect an electrical power supply, wherein the contact means comprises at least one second connecting means having receiving means for a second link plate.

According to the invention, both of the connecting means comprise at least one flat portion and the first and the second connecting means interlock so as to result in a force-closed connection between the first and the second connecting means by means of at least one clamping means and electrical contact is established at least between a primary surface of the flat portion of said first connecting means and a primary surface of the flat portion of said second connecting means.

Connecting means within the scope of the present invention is understood to mean every means which, by interacting with another connecting means, effects a substantially force-closed connection between the two connecting means. Connecting means may for example include a clamp securing a pin or a plate. Connecting means in the sense of the present invention is also understood to include at least partially meshing or interlocking means.

Electrical contact means is understood to include means designed to establish contact with an electrical power supply.

A flat portion is understood to include a portion forming a surface of specified length and specified width. Such flat portion may be for example the surface of a plate-like component.

In another preferred embodiment at least the receiving means comprises at least one clamping element which results in a form-fitting and/or force-closed connection with at least one link plate.

Clamping element is understood to mean such elements which are biased and comprise at least two portions capable of exercising clamping force on another element.

It is preferred that at least one clamping element urges the flat portions at least of the receiving means and the second link plate against one another and in another preferred embodiment comprises at least one curved portion.

It is particularly preferred that at least the contact means comprises at least two clamping elements.

In another preferred embodiment at least the second link plate is substantially, at least sectionally, surrounded by the receiving means. Substantially surrounded is understood to mean that the surrounding connecting means does not have to continuously surround the surrounded connecting means but it surrounds a specified peripheral portion of the surrounded connecting means which portion is larger than 50%, preferably larger than 60% and particularly preferred larger than 70%.

In another preferred embodiment the first and the second connecting means are pressure-joined with each other such that preferably a form-fitting and/or force-closed connection between the connecting means is established.

In another preferred embodiment at least the contact means consists at least partially of a material selected from a group of materials including copper, brass, in particular but not exclusively tin-plated brass, aluminum, iron and the like.

In another preferred embodiment at least the contact means comprises nickel (Ni) at a percentage between 0.2% and 5%, preferably between 0.5% and 3% and particularly preferred between 0.8% and 1.8%.

It is preferred that at least the contact means comprises silicon (Si) at a percentage between 0.05% and 2%, preferably between 0.1% and 1% and particularly preferred between 0.15% and 0.35%.

In another preferred embodiment at least the contact means comprises phosphorus (P) at a percentage between 0.001% and 1%, preferably between 0.005% and 0.3% and particularly preferred between 0.01% and 0.1%.

It is particularly preferred that at least the contact means comprises nickel at a percentage of 0.8% to 1.8%, silicon at a percentage of 0.15% to 0.35%, phosphorus at a percentage of 0.01% to 0.1% and copper at the balance percentage resulting after subtracting from 100% the portions of nickel, silicon, and phosphorus.

It has been found that the quantities of the individual components mentioned above contribute to guaranteeing reliable functioning of the plug-in connection over a broad temperature range. Thus, reliable operation of the connections within a temperature span ranging at least from −40 degrees centigrade to 130 degrees centigrade is possible where the high temperatures mentioned can occur for example by interaction of high ambient temperature and additional heating-up by electric current.

In another preferred embodiment at least the contact means is at least partially made of brass (CuZn) and particularly preferred of tin-plated brass.

In another preferred embodiment at least the contact means is connected to a cable. Said cable preferably serves to connect the connecting means to a terminal of a power supply. It is preferred that at least the contact means is connected to a control system which controls the current flowing through said first component.

In another preferred embodiment at least one part element of at least one second component is made of a group of materials including copper, brass, in particular but not exclusively tin-plated brass, iron and the like.

It is preferred that said first component comprises at least one heating means selected from a group of heating means comprising PTC heating elements, resistance heating elements, plasma heating elements and the like.

In another preferred embodiment a plurality of first and second part elements is provided in an alternating arrangement, wherein it is preferred that first components are positioned between part elements. Said first and second part elements are preferably contact sheets connected with opposite terminals of a power supply. The alternating arrangement is designed to guarantee that a current flows through the first component which is placed between part elements. Although it is possible to position said first components directly between said first and second part elements, it is preferred to provide between the individual part elements additional, in particular conducting, elements such as corrugated ribs, additional contact sheets and the like.

In another preferred embodiment at least one clamping means is provided between at least the contact means and at least one part element. It is preferred that the link plate at the end of the at least one part element engages with the at least one second clamping means so as to establish a force-closed and/or a form-fitting, detachable connection.

In another preferred embodiment at least one link plate comprises at least a partially rounded and/or beveled surface. Said surface preferably serves to facilitate pushing the respective connecting means into one another.

In another preferred embodiment at least one flat portion comprises at least one electrically conductive, structured subsection. The latter is preferably structured by surface shapes selected from a group including ridges, fins, naps, holes, recesses, roughening or the like.

In another preferred embodiment the longitudinal directions of the first and the second link plates are substantially parallel relative each other. Coinciding longitudinal directions are also considered parallel in the sense of the present invention. It is preferred that the longitudinal direction of the first end link plate coincides with the longitudinal direction of the part element of the second component.

In another preferred embodiment, in assembled condition the first and the second link plates are twisted at a predetermined angle $\alpha$ relative the longitudinal direction of the link plates. This is to be understood such that the flat portions of the two link plates are twisted relative each other at the predetermined angle. Preferably the angle $\alpha$ is between 0 degrees and 90 degrees, preferred between 0 degrees and 45 degrees and particularly preferred between 0 degrees and 20 degrees. In another preferred embodiment the angle $\alpha$ is approximately 90 degrees.

The method of the invention of manufacturing the device of the invention or a preferred embodiment comprises at least the following steps.

Punching at least one shaped element from a substantially flat sheet, in particular but not exclusively a metal sheet, transferring two shaped elements into at least one first and at least one second component according to the invention using at least one method such as in particular but not exclusively bending.

It is preferred to structure at least one electrically conductive subsection of the receiving means of the invention by shaping the surface in punching and/or in at least one shaping process.

The present invention further relates to applying the device specified above for exchanging heat in an air-conditioning system in particular for motor vehicles.

BRIEF DESCRIPTION OF THE DRAWINGS

Further advantages and embodiments of the device of the present invention for exchanging heat can be taken from the accompanying drawings.

DETAILED DESCRIPTION OF THE PREFERRED EMBODIMENT

Figure 1:
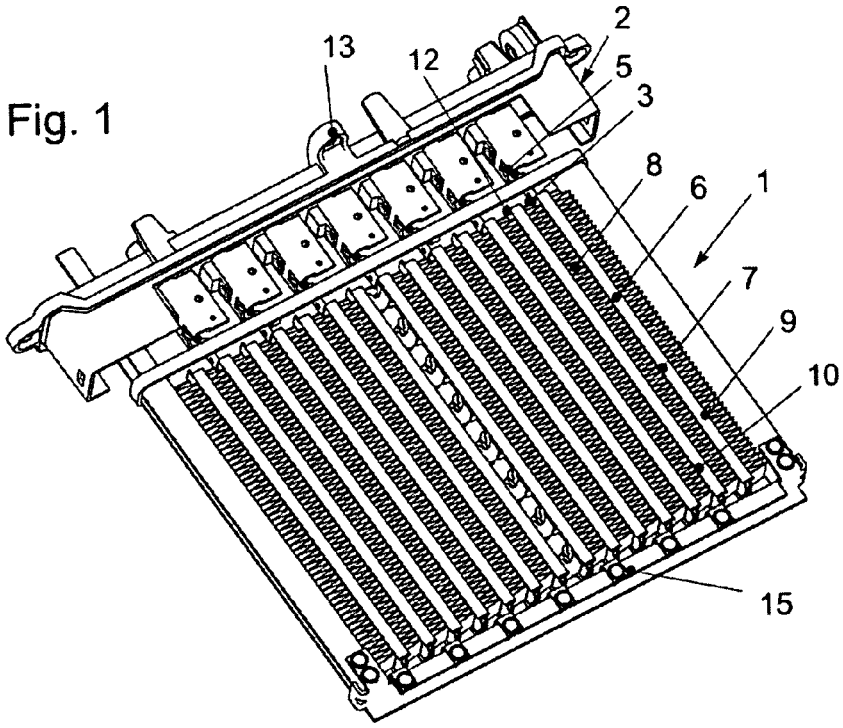
FIG. 1 is a total view of a device for exchanging heat.

FIG. 1 shows a device for exchanging heat in a total view.

Reference numeral 1 designates a frame- and contact means which serves to supply electrical energy to the device for exchanging heat. Reference numeral 6 designates a first component, which may in particular but not exclusively be a PTC element. A part element 7 of a second component rests against said first component. This part element may in particular but not exclusively be a contact sheet. Said contact sheet comprises an end link plate 3 which serves to supply electrical energy.

Reference numeral 10 refers to a second part element of the second component also comprising a contact component or link plate 12. This link plate 12 is preferably connected to the opposite terminal of a current or power supply so as to ultimately generate a current flow through, and thus to heat up, the first component 6. Furthermore, between the individual first components, corrugated ribs 8 are provided which serve to support heat exchange with the ambient air. Reference numeral 15 refers to a frame element for fastening the above-mentioned devices.

Figure 2:
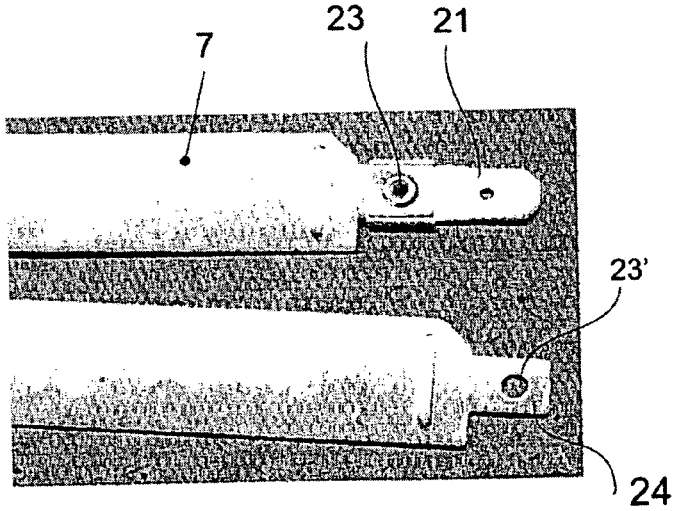
FIG. 2 is a prior art connecting means.

FIG. 2 shows the connecting means between the metal unit or contact sheets of the second component 7 and a contact link plate or contact means 21, wherein a rivet connection 23 is provided. Reference numeral 24 designates a link plate not visible in the upper Figure comprising an opening intended for the riveted connection. One drawback of this rivet connection is, as stated above, that the contact surface provided between the part element 7 and the contact link plate 24 is relatively small. It is ultimately this small contact surface which with equal current flow results in raised temperature at the connecting point.

Figure 3:
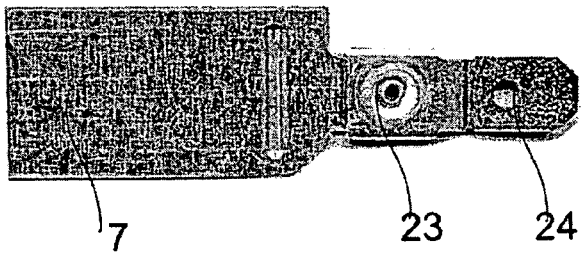
FIG. 3 is a rear view of the connecting means in FIG. 2.

FIG. 3 shows a rear view of the connection of the contact sheet with the link plate. Again, the rivet connection is clearly recognizable.

Figure 4:
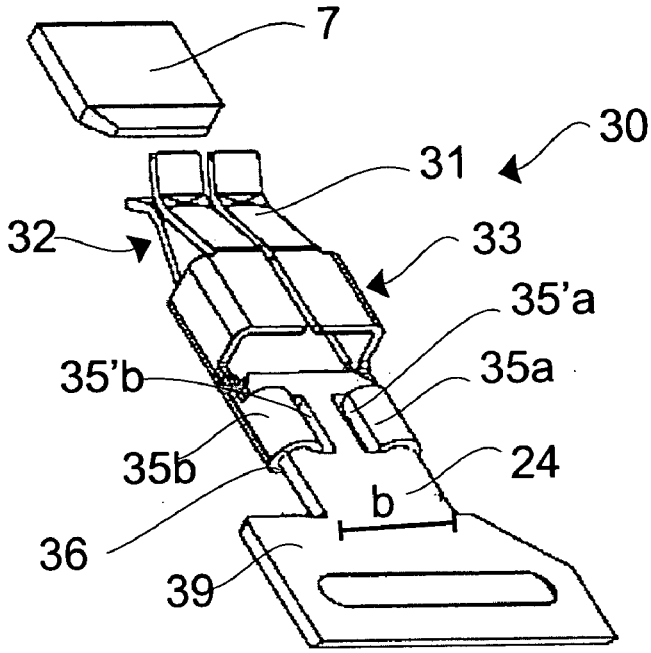
FIG. 4 is a perspective view of the connecting means of the invention.

FIG. 4 shows the contact means 30 of the invention for the device for exchanging heat. In place of the rivet connection shown in FIG. 3, a clip connection having two clamping means 35*a* and 35*b* between the second link plate 24 and the contact means 30 is used in this case. In this embodiment, the link plate 24 comprises two beveled end areas which facilitate insertion into the clamping means. In addition, rounded edges and the like may be provided. Said clamping means 35*a* and 35*b* cause that the link plate 24 is pressed against a flat portion 36 of the contact means. Reference numeral 7 designates the part element of the second component which can be pushed, preferably detachably, into the first connecting means 32 or into its clamps 31. In the present embodiment, the components 31 are resilient so as to ultimately assist with clamping the part element 7. The link plate 24 has a predetermined width b.

Figure 5:
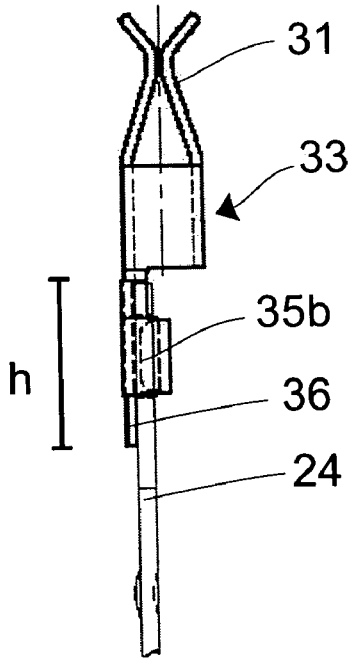
FIG. 5 is a side view of the connecting means of the invention in FIG. 4.

FIG. 5 is a side view of the illustration in FIG. 4. It can be recognized that the clamping means 35*b* urges the link plate 24 against the flat portion 36 of the contact means 30. In this way it can be achieved that between the link plate 24 and the flat portion 36 a contact surface is generated resulting substantially from the product of the width b of the link plate 24 with the height h where the flat portion 36 and the link plate 24 overlap. A further contact is established along the respective side faces of the connecting means or the link plate 24 and, as shown in FIG. 4, at part of that surface of the link plate 24 that points upward.

As can be taken from FIG. 4, the clamps 31 are beak-shaped in cross-section. Said clamps are first tapering to a V-shape in the lower portion of the Figure, then they contact each other in one portion after which they diverge again substantially in a V-shape. In this embodiment the aperture angle above the contact portion is larger than that below the contact portion. In assembled condition the two contact portions of the clamps 31 rest against the contact sheet 7 as the thin line indicates. This embodiment uses two clamps 31. However, it is also conceivable to provide more or fewer clamps. It is also possible to provide different numbers of clamp part elements at the two sides.

The two clamping means 35*a* and 35*b* have also end portions 35'*a* and 35'*b* which results in further increasing the contact surface between the contact means 30 and the second link plate 24.

The connecting means may, however, be configured in reverse order, i.e. to provide the clamping means 35*a* and 35*b* at the second link plate 24 and one link plate at the first connecting means 33. It is furthermore conceivable to provide clamping means both at the contact means and the second link plate 24, which clamping means interlock with each other.

Figure 6:
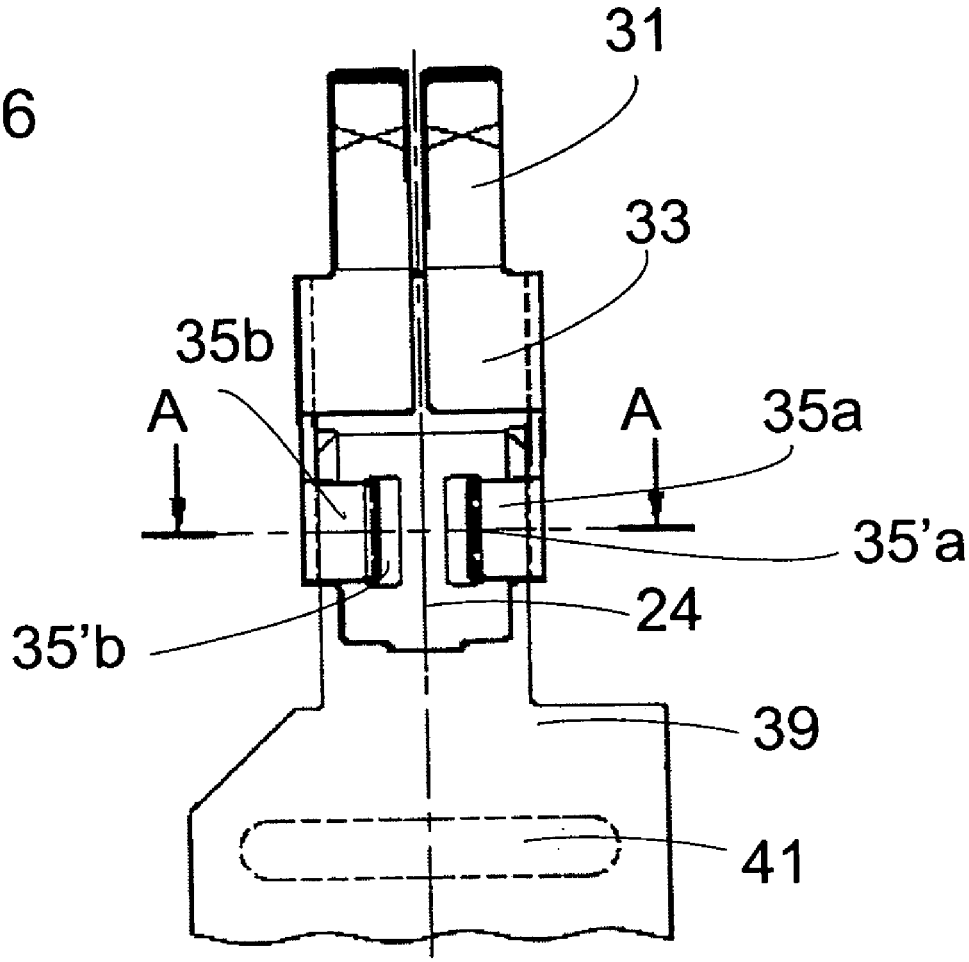
FIG. 6 is a top view of the connecting means in FIG. 4.

FIG. 6 is a top view of the contact means 30 shown in FIGS. 4 and 5. It can be recognized that the end portions 35'*b* and 35'*a* are larger in the direction h than the other portions of the clamping means 35*a* and 35*b*. It can further be seen that the second link plate 24 comprises a beveled end portion to facilitate pushing them into one another so as to establish a connection between the connecting means 24 and 36. The lower portion 39 of the second link plate 24 serves as a connection to a power supply which connection can be established for example by means of the opening 41.

Figure 7:
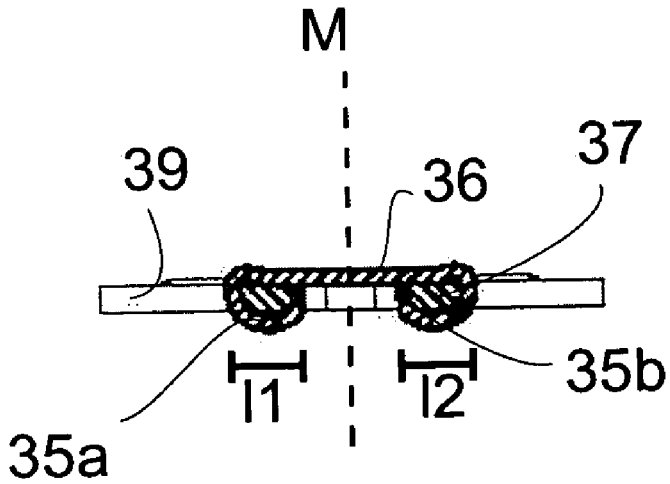
FIG. 7 is another top view along the lines A—A in FIG. 6.

FIG. 7 is a top view of the device in FIG. 6 along the lines A—A. Hatching in particular illustrates those areas where the mechanical connection of the contact means 30 with the second link plate 24 is established. One can also see that the contact surface provided, in addition to the above-mentioned surface opened by width b and height h, is also the area of the second connecting means 24 surrounded by the clamping means 35*a* and 35*b*. The end portions 35*a*' and 35*b*' can be placed still closer to the center line m so as to enlarge the contact area still further.

As can be taken from FIG. 7, the clamping means 35*a* and 35*b* comprise an arch-like portion each which at least partially surround a side area of the second link plate 24. It is preferred that the clamping means contact the second link plate 24 substantially along said entire arch-like portion. Substantially along said entire arch-like portion is understood to mean that contact possibly may not occur in small areas where the link plate 24 is opposite steep curves of the clamping means 35*a* and 35*b*, such as in FIG. 7 there may possibly be no contact at some portions of the underside of the link plate 24.

The arch-like portion may be configured such that at least part of it is a circle line but other structures such as ellipsoidal curves are also conceivable.

It is further recognizable that the second link plate 24 is thicker than the flat portion 36 (hatched). However, equal thicknesses are also conceivable or the second link plate 24 may be thinner than the flat portion 36.

In this embodiment the thickness of the flat portion is further substantially equal to the thickness of the clamping means 35*a* and 35*b*. Different thicknesses can, however, also be chosen.

Suitable methods such as in particular but not exclusively pressing may be used to achieve substantially continuous contact between the contact means and the second link plate along the lines 11 and 12.

Reference numeral 33 is a center area of the contact means 30. Said center area is of predetermined height and substantially rectangular in cross-section where the clamping means 31 for the first part element 7 are positioned at the respective longitudinal faces of said center area. Alternatively to substantially rectangular cross-sections, other cross-sections may be used such as generally polygon cross-sections, ellipsoidal cross-sections and the like.

In FIG. 6 the center area 33 is not closed but the top surface is cut through in longitudinal direction. The cross-section of the center area has rounded corners. The bottom face of the center area 33 directly merges into the flat portion 36 wherein the width of the center area is substantially identical with the width of the flat portion 35.

It is preferred that the center area 33 is made of electrically insulating material or surrounded by such material.

The invention claimed is:

1. A device for exchanging heat, in particular for motor vehicles, comprising:

at least one first component connected to an electrical power supply, and whose temperature varies dependent on current flowing through the component;

at least one second component comprising at least one first and at least one second part element, each of which are at least indirectly conductively connected to the first component, wherein at least one part element comprises a first link plate at its end;

at least one electrical contact means which is conductively connected to the link plate of the at least one part element by means of a first connecting means and serves to connect an electrical power supply, wherein the contact means comprises at least one second connecting means having receiving means for a second link plate; and the connecting means comprises a flat portion and in assembled condition the receiving means and the second link plate interlock so as to result in a force-closed connection between the receiving means and the second link plate by means of at least one clamping means and electrical contact is established at least between the flat portion of the receiving means and a flat portion of the second link plate.

2. The device of claim 1, wherein at least the receiving means comprises at least one clamping component which results in a form-fitting connection with at least one link plate.

3. The device of claim 1, wherein at least one clamping component urges the flat portions at least of the receiving means and the second link plate against one another.

4. The device of claim 1, wherein at least one clamping element comprises at least one curved portion.

5. The device of claim 1, wherein at least one connecting means comprises at least two clamping elements.

6. The device of claim 1, wherein at least the second link plate is at least sectionally substantially surrounded by the receiving means.

7. The device of claim 1, wherein the contact means consists at least partially of a material selected from a group of materials including copper, brass, in particular but not exclusively tin-plated or zinc-coated brass, aluminum, iron and the like.

8. The device of claim 1, wherein the contact means comprises nickel (Ni) at a percentage between 0.2% and 5%, preferably between 0.5% and 3% and particularly preferred between 0.8% and 1.8%.

9. The device of claim 1, wherein the contact means comprises silicon (Si) at a percentage between 0.05% and 2%, preferably between 0.1% and 1% and particularly preferred between 0.15% and 0.35%.

10. The device of claim 1, wherein the contact means comprises phosphorus (P) at a percentage between 0.001% and 1%, preferably between 0.005% and 0.3% and particularly preferred between 0.01% and 0.1%.

11. The device of claim 1, wherein the contact means comprises nickel at a percentage of 0.8% to 1.8%, silicon at a percentage of 0.15% to 0.35%, phosphorus at a percentage of 0.01% to 0.1% and copper at the balance percentage resulting from subtracting the portions of nickel, silicon, and phosphorus.

12. The device of claim 1, wherein the contact means is at least partially made of brass (CuZn).

13. The device of claim 1, wherein the contact means is at least partially made of tin-plated brass.

14. The device of claim 1, wherein the contact means is connected to a cable.

15. The device of claim 1, wherein the contact means is connected to a control system.

16. The device of claim 1, wherein at least one part element of at least one second component is made of a group of materials including copper, brass, in particular but not exclusively tin-plated or zinc-coated brass, iron and the like.

17. The device of claim 1, wherein the first component comprises at least one heating means selected from a group of heating means comprising PTC heating elements, resistance heating elements, plasma heating elements and the like.

18. The device of claim 1, wherein a plurality of first and second part elements are provided in an alternating arrangement.

19. The device of claim 1, wherein corrugated ribs are provided between the first components.

20. The device of claim 1, wherein at least one second clamping means is provided between the contact means and at least one part element.

21. The device of claim 1, wherein the end link plate of the at least one part element engages with the at least one second clamping means so as to establish a form-fitting, detachable connection.

22. The device of claim 1, wherein at least one link plate comprises at least a partially rounded and/or beveled surface.

23. The device of claim 1, wherein at least one flat portion comprises at least one electrically conductive, structured sub-section.

24. The device of claim 1, wherein at least one electrically conductive, structured sub-section is structured by surface shapes selected from a group including ridges, fins, naps, fishskin texture, holes, recesses, roughening or the like.

25. The device of claim 1, wherein the longitudinal directions of the first and the second link plates are substantially parallel.

26. The device of claim 1, wherein in assembled condition the first and the second link plates are twisted relative each other by a specified angle $\alpha$ relative the longitudinal direction of the link plates.

27. The device of claim 1, wherein the angle $\alpha$ is between 0° and 90°, preferred between 0° and 45° and particularly preferred between 0° and 10°.

* * * * *